US006443707B1

(12) United States Patent
Kimura et al.

(10) Patent No.: US 6,443,707 B1
(45) Date of Patent: Sep. 3, 2002

(54) CONTROL VALVE FOR VARIABLE DISPLACEMENT COMPRESSOR

(75) Inventors: Kazuya Kimura; Hiroaki Kayukawa, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/600,504

(22) PCT Filed: Feb. 23, 1999

(86) PCT No.: PCT/JP99/00786

§ 371 (c)(1),
(2), (4) Date: Jul. 18, 2000

(87) PCT Pub. No.: WO00/50775

PCT Pub. Date: Aug. 31, 2000

(51) Int. Cl.[7] ..... F04B 1/26
(52) U.S. Cl. ..... 417/222.2; 251/62
(58) Field of Search ..... 417/222.2; 251/61, 251/62, 67, 74, 297

(56) References Cited

U.S. PATENT DOCUMENTS 4,428,718 A * 1/1984 Skinner ..... 417/222
4,480,964 A * 11/1984 Skinner ..... 417/222
6,022,086 A * 2/2000 Braum ..... 303/119.2
6,146,106 A * 11/2000 Suitou et al. ..... 417/222.2
6,234,763 B1 * 5/2001 Ota et al. ..... 417/222.2

FOREIGN PATENT DOCUMENTS

| | | | |
|---|---|---|---|
| JP | 61-145141 | 9/1986 | ..... F16F/9/46 |
| JP | 4-119271 | 4/1992 | ..... F16K/31/06 |
| JP | 6-63973 | 9/1994 | ..... F16K/31/06 |
| JP | 9-42510 | 2/1997 | ..... F16K/31/04 |

OTHER PUBLICATIONS

Unexamined Utility Model Publication 6–63973: Endo, et al, Sep. 9, 1994, Japan.*

* cited by examiner

*Primary Examiner*—Charles G. Freay
*Assistant Examiner*—Han Lieh Liu
(74) *Attorney, Agent, or Firm*—Morgan & Finnegan, LLP

(57) ABSTRACT

A control valve for variable displacement compressor that prevents fluid fixation between a rod and a guide hole is provided. A first rod (89) extends through a first guide hole (88) to couple a bellows (87) to a valve body (74). A second rod (96) extends through a second guide hole (95) to couple a movable iron core (93) to the valve body (74). Tapered surfaces (89*b*, 96*b*) are formed on the outer surfaces of the first and second rods (89, 96). The space-between each tapered surface (89*b* 96*b*) and the inner surface (88*a*, 95*a*) of the corresponding guide hole (88, 95) is wider in the vicinity of a high pressure zone (73, 90) than in the vicinity of a low pressure zone (84, 91).

23 Claims, 10 Drawing Sheets

CONTROL VALVE FOR VARIABLE DISPLACEMENT COMPRESSOR

BACKGROUND OF THE INVENTION

The present invention relates to a control valve for variable displacement compressors that are used in vehicle air conditioners.

A typical variable displacement compressor includes a control passage for connecting a discharge pressure zone with a crank chamber. The pressure in the crank chamber is adjusted to change the inclination of a cam plate. Accordingly, the displacement is controlled.

Japanese Unexamined Patent Publication No. 4-119271 discloses a typical control valve for variable displacement compressors. As shown in FIG. 7, this control valve has a valve chamber 101 in a distal portion of a valve housing 102. The valve chamber 101 is connected to a discharge pressure zone by the upstream portion of a control passage 103. The valve chamber 101 is also connected to a crank chamber by a valve hole 104, a port 105 and the downstream portion of the control passage 103. The valve hole 104 is formed axially in the housing 102 and the port 105 is perpendicular to the valve hole 104. A valve body 106 is housed in the valve chamber 101 to open and close the valve hole 104.

A pressure sensing chamber 107 is formed adjacent to the valve chamber 101 and is connected to a suction pressure zone. A bellows 108 is housed in the pressure sensing chamber 107 to detect the pressure of the suction pressure zone. The pressure sensing chamber 107 is separated from the valve chamber 101 by a dividing wall 102*a*. A guide hole 109 is formed in the dividing wall 102*a* to be continuous with the valve hole 104. The chambers 101 and 107 are therefore connected to each other. A rod 110 is slidably fitted in the guide hole 109 to couple the bellows 108 with the valve body 106. The bellows 108 is deformed in accordance with the suction pressure of the refrigerant gas. The deformation of the bellows 108 is transmitted to the valve body 106 by the rod 110.

A solenoid portion 111 is attached to a proximal portion of the valve housing 102 and is coupled to the valve body 106 by the bellows 108. The solenoid portion 111 is excited and de-excited for changing the attraction force between a fixed iron core 112 and a movable iron core 113. Accordingly, the load acting on the valve body 106 is changed. Therefore, the opening size of the control passage 103 is determined by the equilibrium of forces, such as the force of the solenoid portion 111 and the force of the bellows 108.

The pressure in the port 105 is relatively high and the pressure in the pressure sensing chamber 107 is relatively low. The rod 110 and the guide hole 109 are machined with meticulous care for allowing the rod 110 to slide in the hole 109 and for preventing leakage of gas between the port 105 and the pressure sensing chamber 107. However, small machining errors are inevitable, and the space between the surface of the rod 110 and the surface of the guide hole 109 is different between a location near the port 105 and a location near the pressure sensing chamber 107. Particularly, when the space near the port 105 is smaller than the space near the pressure sensing chamber 107, the pressure difference between the port 105 and the pressure sensing chamber 107 generates a lateral force acting on the rod 110. The lateral force presses the rod 110 against the surface of the guide hole 109, which increases the sliding resistance between the rod 110 and the guide hole 109 (this phenomena will hereafter be referred to as fluid fixation).

A recent trend is to reduce the size of the solenoid portion 111 to reduce the size of the compressor. In a valve having a small solenoid portion 111, the bellows 108 is relatively small and the valve body 106 is moved by the equilibrium of the difference between small forces, that is, the force of the solenoid portion 111 and the force of the bellows 108. Therefore, the control valve is easily affected by an increase of the sliding resistance between the rod 110 and the guide hole 109 due to the fluid fixation. As a result, even a small sliding resistance, which would be negligible if the bellows 108 were large, causes hysteresis. Therefore, the controllability of the displacement significantly deteriorates.

SUMMARY OF THE INVENTION

The present invention was made in view of drawbacks in the above described prior art. Accordingly, it is an objective of the present invention to provide a control valve for a variable displacement compressor that reduces sliding resistance between a rod and a guide hole.

To achieve the foregoing objective, the present invention provides a control valve for a variable displacement compressor. The control valve includes a valve body. The valve body opens and closes a control passage, which connects a control pressure chamber with a suction pressure zone or with a discharge pressure zone, to adjust the opening size of the control passage for varying the displacement of the compressor. The valve body is opened and closed by a drive member. A dividing wall separates a portion that accommodates the valve body from a portion that accommodates the drive member. A guide hole is formed in the dividing wall to communicate the valve body accommodating portion with the drive member accommodating portion. A sliding rod is located in the guide hole to operably couple the valve body to the drive member. The control valve is characterized by means for preventing fluid fixation. The fluid fixation preventing means is located on at least one of the outer surface of the rod and on the inner surface of the guide hole.

The invention of the above structure has the means for preventing fluid fixation between the rod and the guide hole, which decreases the hysteresis of the control valve and prevents deterioration of the displacement controlling performance of the control valve.

In the above structure, the means may include a tapered surface formed on at least one of the outer surface of the rod and the inner surface of the guide hole such that the space between the outer surface of the rod and the inner surface of the guide hole widens toward one of the valve body accommodating portion and the drive member accommodating portion that has a higher pressure.

If the axis of the rod is displaced from the axis of the guide hole for some reason, the rod receives a lateral force, the direction of which is opposite to the displacement direction. The misalignment of the axes is automatically corrected.

In the above structures, the tapered surface may be one of a plurality of tapered surfaces formed along the axial direction of the rod.

In this structure, the cross-sectional area of the space between the outer surface of the rod and the inner surface of the guide hole changes in the axial direction in a completed fashion and functions like a labyrinth seal. This effectively prevents pressure leakage and refrigerant gas leakage between the high pressure location and the low pressure location.

In the above structure, the outer surface of the rod may be tapered such that the diameter of the rod decreases toward one of the valve body accommodating portion and the drive member accommodating portion that has higher pressure. This eliminates the necessity for tapering the inner wall of the guide hole, which is formed in the dividing wall and has a small cross-section, by inserting a tool into the guide hole.

In the above structures, the means may include a circumferential annular groove formed in at least one of the outer surface of the rod and the inner surface of the guide hole.

The annular groove circumferentially equalizes the pressure in the space between the outer surface of the rod and the inner surface of the guide hole. Accordingly, fluid fixation does not occur between the rod and the guide hole.

If the annular groove is formed in the outer surface of the rod, the groove is easily formed.

In the above structure, the drive member may include a pressure sensing mechanism having a pressure sensing chamber and a pressure sensing member located in the pressure sensing chamber. The pressure sensing chamber is connected either with the suction pressure zone or with the control pressure chamber by a pressure introduction passage. The rod operably couples the pressure sensing member with the valve body.

In this structure, the pressure sensing member is deformed by pressure in the pressure sensing chamber, that is, by either the pressure of the suction pressure zone or the pressure in the control pressure chamber. The deformation is transmitted to the valve body by the rod.

In the above structure, the drive member may include a solenoid portion. The solenoid portion is excited and de-excited to actuate a plunger accommodated in a plunger chamber. The rod operably couples the plunger with the valve body.

In this structure, the plunger is moved by excitation and de-excitation of the solenoid portion. The movement of the plunger is transmitted to the valve body by the rod.

In the above structure, the drive member may include a pressure sensing mechanism and a solenoid portion. The pressure sensing mechanism may include a pressure sensing chamber and a pressure sensing member located in the pressure sensing chamber. The pressure sensing chamber is connected either with the suction pressure zone or with the control pressure chamber by a pressure introduction passage. The solenoid portion is excited and de-excited to actuate a plunger accommodated in a plunger chamber. The rod may include a first rod portion, which operably couples the pressure sensing member with the valve body, and a second rod portion, which operably couples the plunger with the valve body.

In this structure, the opening size of the control passage is determined by the position of the valve body, which is determined by the equilibrium of the force of the pressure sensing mechanism and the force of the solenoid portion.

In the above structure, the control passage may connect the discharge pressure zone with the control pressure chamber.

In this structure, the amount of refrigerant gas drawn into the control pressure chamber is adjusted for controlling the displacement. Highly pressurized gas is introduced into the control valve. Fluid fixation between the rod and the guide hole causes the rod to be pressed against the guide hole by a greater force compared to a control valve that adjusts the amount of refrigerant gas discharged from the control pressure chamber to control the compressor displacement. Therefore, the present invention has a great advantage.

DETAILED DESCRIPTION OF THE PREFERRED EMBODIMENTS

Figure 1A:
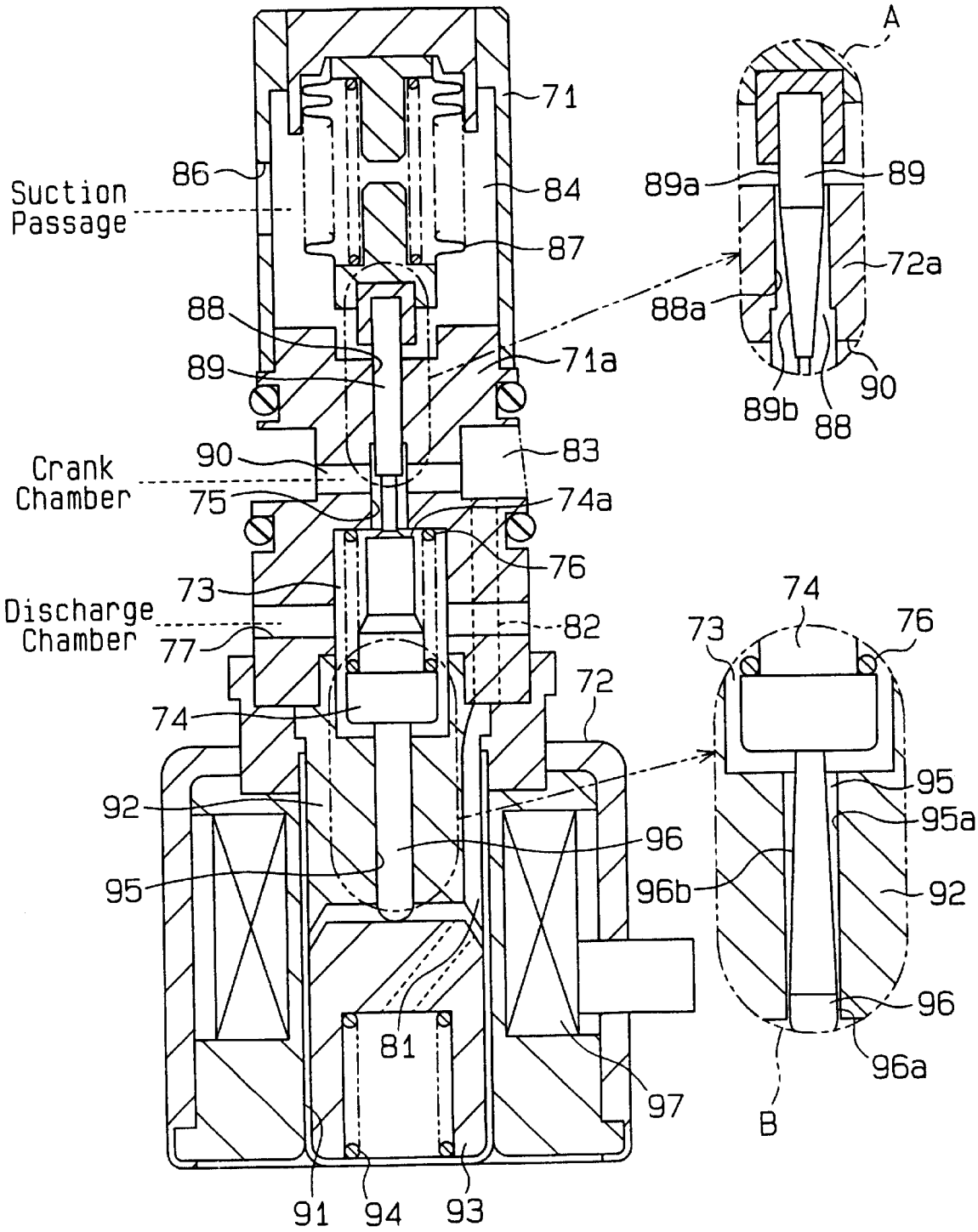
FIG. 1A is a cross-sectional view of a control valve according to a first embodiment of the present invention, in which the outer surface of the rod is tapered.

Displacement control valves used in variable displacement compressors according to first to third embodiments will now be described. The displacement control valves of the first and second embodiments are used in a clutchless type variable displacement compressor, while the control valve according to the third embodiment is used in another type variable displacement compressor. In the descriptions of the second and third embodiments, only differences from the first embodiment will be discussed. Like or the same reference numerals are given to those components that are like or the same as the corresponding components of the first embodiment.

(First Embodiment)

First, the structure of the clutchless type variable displacement compressor will be described.

Figure 2:
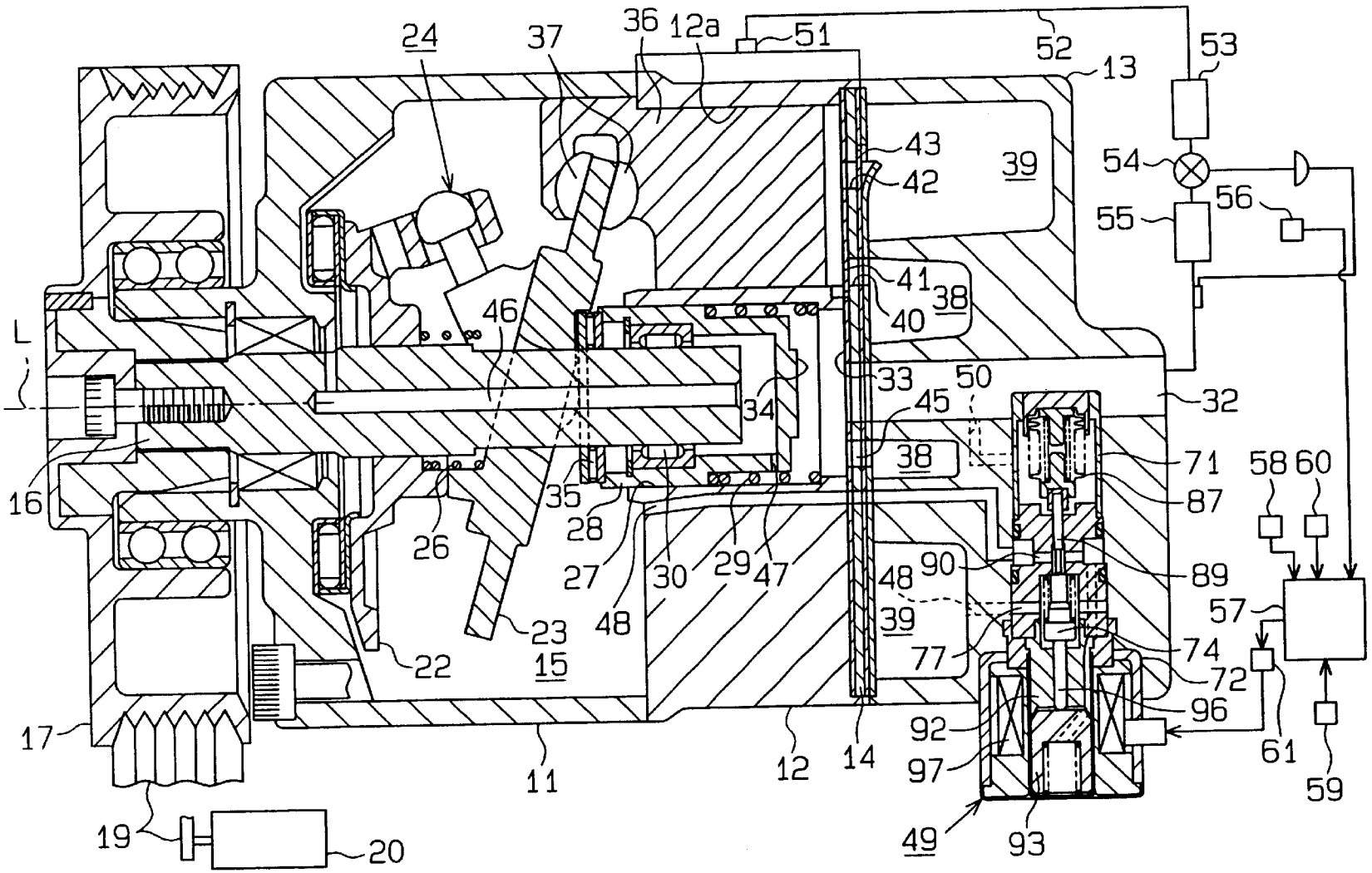
FIG. 2 is a cross-sectional view illustrating a clutchless type variable displacement compressor.

As shown in FIG. 2, a front housing 11 is secured to the front end face of a cylinder block 12. A rear housing 13 is secured to the rear end face of the cylinder block 12, and a valve plate 14 is located between the rear housing 13 and the cylinder block 12. The front housing 11 and the cylinder block 12 define a control pressure chamber, which is a crank chamber 15. A drive shaft 16 extends through the crank chamber 15 and is rotatably supported by the front housing 11 and the cylinder block 12. A pulley 17 is rotatably supported by the front housing 11. The pulley 17 is coupled to the drive shaft 16. A belt 19 is engaged with the periphery of the pulley 17 to directly couple the pulley 17 with a vehicle engine 20 without a clutch such as an electromagnetic clutch.

A lug plate 22 is secured to the drive shaft 16 in the crank chamber 15. A swash plate 23 is supported by the lug plate 22 to slide axially and to incline with respect to the axis L of the drive shaft 16. A hinge mechanism 24 is located between the lug plate 22 and the swash plate 23. The hinge mechanism 24 permits the swash plate 23 to incline with respect to the axis L of the drive shaft 16 and to rotate integrally with the drive shaft 16. As the radial center of the swash plate 23 slides toward the cylinder block 12, the inclination of the swash plate 23 decreases. A spring 26 for decreasing the inclination is located between the lug plate 22 and the swash plate 23. The spring 26 urges the swash plate 23 in the direction of disinclination of the swash plate 23. The maximum inclination of the swash plate 23 is defined by contact between the swash plate 23 and the lug plate 22.

Figure 3:
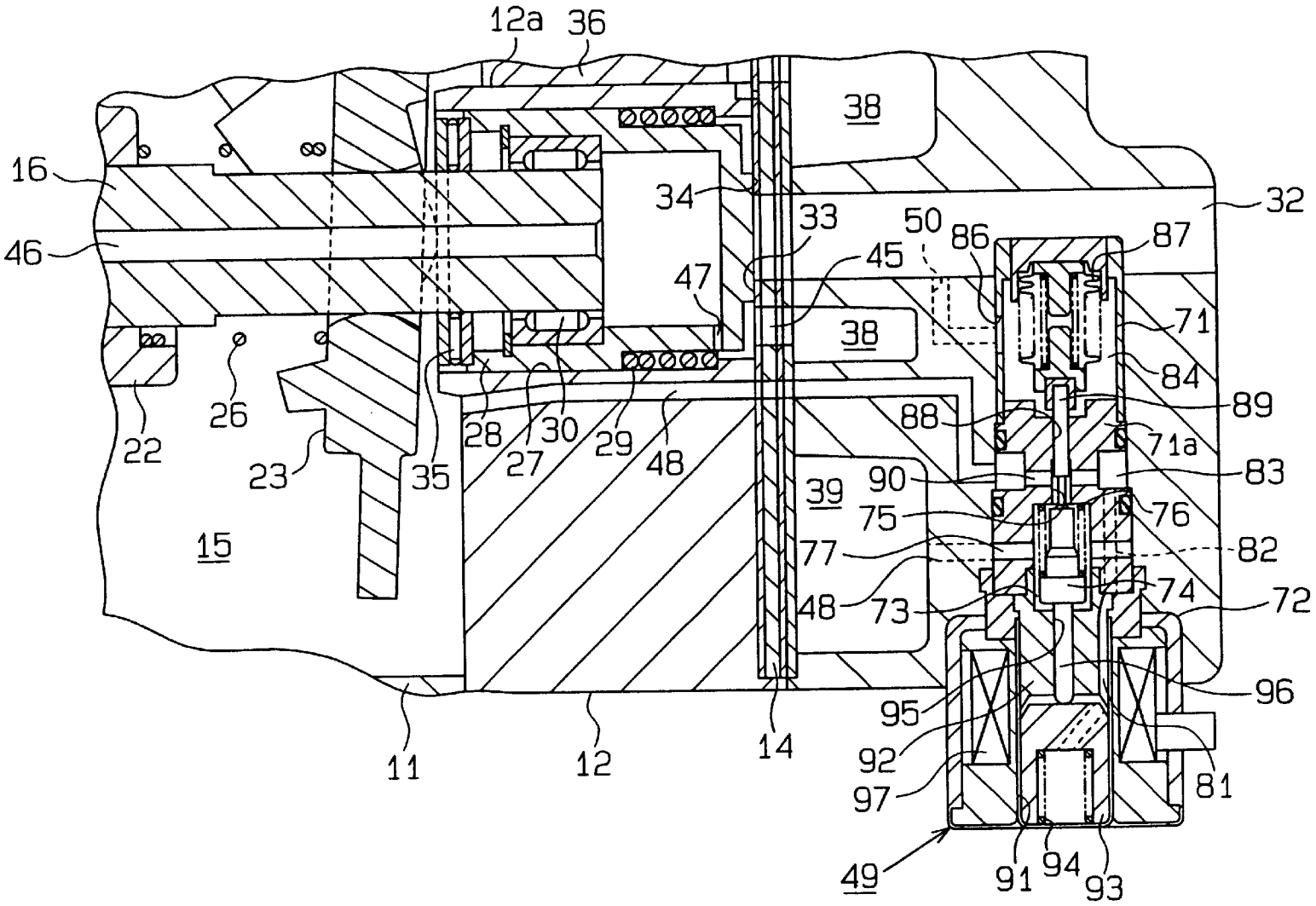
FIG. 3 is an enlarged partial cross-sectional view showing a compressor in which the displacement is minimum.

As shown in FIG. 3, an accommodation chamber 27 is formed in the center of the cylinder block 12 and extends along the axis L of the drive shaft 16. A sliding cylindrical shutter 28 is accommodated in the accommodation chamber 27. A spring 29 for opening a suction passage is located between an end of the chamber 27 and the shutter 28 and urges the shutter 28 toward the swash plate 23.

The rear end portion of the drive shaft 16 is located in the shutter 28. A radial bearing 30 is located between the rear end portion of the drive shaft 16 and the inner wall of the shutter 28. The radial bearing 30 slides with the shutter 28 with respect to the drive shaft 16 along the axis L.

A suction passage 32, which is part of the suction pressure zone, is formed in the center of the rear housing 13 and the valve plate 14. The suction passage 32 communicates with the accommodation chamber 27. A positioning surface 33 is defined on the valve plate 14 about an opening of the passage 32. A shutting surface 34 is defined on an end of the shutter 28. The shutting surface 34 contacts and separates from the positioning surface 33 in accordance with the position of the shutter 28. When the shutting surface 34 contacts the positioning surface 33, the surfaces 33, 34 seal the interior of the accommodation chamber 27 from the suction passage 32.

A thrust bearing 35 is located between the swash plate 23 and the shutter 28 such that the swash plate 23 slides along the drive shaft 16. The thrust bearing 35 is urged by the spring 29 and is normally held between the swash plate 23 and the shutter 28. As the swash plate 23 inclines toward the shutter 28, the inclination of the swash plate 23 is transmitted to the shutter 28 through the thrust bearing 35. Accordingly, the shutter 28 is moved toward the positioning surface 33 against the force of the spring 29 and the shutting surface 34 of the shutter 28 contacts the positioning surface 33. The contact between the shutting surface 34 and the positioning surface 33 prevents the swash plate 23 from being further inclined. In this state, the swash plate 23 is at the minimum inclination, which is slightly more than zero degrees.

Cylinder bores 12*a* are formed in the cylinder block 12. A single-headed piston 36 is accommodated in each cylinder bore 12*a*. Each piston 36 is coupled to the periphery of the swash plate 23 by way of a pair of shoes 37. The pistons 36 are reciprocated by rotation of the swash plate 23.

A suction chamber 38, which forms part of suction pressure zone, and a discharge chamber 39, which forms part of discharge pressure zone, are defined in the rear housing 13. Suction ports 40, suction valve flaps 41, discharge ports 42 and discharge valve flaps 43 are formed in the valve plate 14. Each suction valve flap 41 opens and closes one of the suction ports 40 and each discharge valve flap 43 opens and closes one of the discharge ports 42. When moved from the top dead center to the bottom dead center, each piston 36 draws refrigerant gas from the suction chamber 38 to the associated cylinder bore 12*a* via the associated suction port 40 and the associated suction valve flap 41. Refrigerant gas in each cylinder bore 12*a* is compressed to reach a predetermined pressure as the associated piston 36 is moved from the bottom dead center to the top dead center and is discharged to the discharge chamber 39 via the associated discharge port 42 and the associated discharge valve flap 43.

The suction chamber 38 communicates with the accommodation chamber 27 via a communication hole 45. When the shutting surface 34 of the shutter 28 contacts the positioning surface 33, the communication hole 45 is disconnected from the suction passage 32. A passage 46 axially extends in the drive shaft 16 to connect the crank chamber 15 with the interior of the shutter 28. A pressure release hole 47 is formed in the peripheral wall of the shutter 28 to communicate the interior of the shutter 28 with the accommodation chamber 27.

A control passage 48 connects the discharge chamber 39 with the crank chamber 15. A displacement control valve 49 is located in the control passage 48. The suction passage 32 is connected to the control valve 49 by a pressure introduction passage 50.

The suction passage 32 draws refrigerant gas to the suction chamber 38. A discharge outlet 51 discharges refrigerant gas from the discharge chamber 39. The suction passage 32 is connected to the discharge outlet 51 by an external refrigerant circuit 52. The circuit 52 includes a condenser 53, an expansion valve 54 and an evaporator 55. A sensor 56 is located in the vicinity of the evaporator 55. The sensor 56 detects the temperature of the evaporator 55 and sends the detected temperature information to a computer 57. The computer 57 is connected to a temperature adjuster 58, a sensor 59 and an air conditioner switch 60. The temperature adjuster 58 sets the temperature in the passenger compartment. The sensor 59 detects the temperature of the passenger compartment.

The computer 57 receives various information including a target temperature set by the temperature adjuster 58, the temperature detected by the sensor 56, the temperature detected by the sensor 59 and an ON/OFF signal from the air-conditioner switch 60. Based on this information, the computer 57 computes the value of a current supplied to a drive circuit 61. Accordingly, the drive circuit 61 sends a current having the computed value to the control valve 49. In addition to the above listed data, the computer 57 may use other data such as the temperature outside the compartment and the engine speed for determining the magnitude of electric current sent to the control valve 49.

The structure of the control valve 49 will now be described.

As shown in FIGS. 1A, 2 and 3, the control valve 49 includes a valve housing 71 and a solenoid portion 72. The valve housing 71 and the solenoid portion 72 are coupled at the center of the control valve 49. A valve chamber 73 is defined between the valve housing 71 and the solenoid portion 72. The valve chamber 73 is connected to the discharge chamber 39 through a port 77 and the upstream portion of the control passage 48. A valve body 74 is accommodated in the valve chamber 73. A valve hole 75 opens in the valve chamber 73 to face the valve body 74. The valve hole 75 extends along the axis of the valve housing 71. A spring 76 is located between the valve body 74 and the inner wall of the valve chamber 73 to urge the valve body 74 in the direction for opening the valve hole 75.

A pressure sensing chamber 84 is defined in the distal portion of the valve housing 71. The pressure introduction passage 50 is connected to the pressure sensing chamber 84. Therefore, the pressure sensing chamber 84 is connected to the suction passage 32 through a port 86 and the pressure introduction passage 50. A pressure sensing member, which is a bellows 87, is accommodated in the pressure sensing chamber 84.

A guide hole 88 is formed in a dividing wall 71*a* of the valve housing 71, which divides the pressure sensing chamber 84 from the valve chamber 73. The guide hole 88 connects the pressure sensing chamber 84 with the valve chamber 73. The guide hole 88 is formed continuously with the valve hole 75. A sliding rod 89 is located in the guide hole 88. The distal end of the rod 89 is engaged with the bellows 87. The rod 89 is integral with the valve body 74 to operably couple the bellows 87 with the valve body 74. A part of the rod 89 that is connected to the valve body 74 has a small diameter to define a gas passage in the valve hole 75.

A port 90 is formed in the dividing wall 71*a* between the valve chamber 73 and the pressure sensing chamber 84. The port 90 is perpendicular to the valve hole 75. The port 90 is connected to the crank chamber 15 through the downstream portion of the control passage 48. That is, the port 77, the valve chamber 73, the valve hole 75 and the port 90 form part of the control passage 48.

A plunger chamber 91 is defined in the solenoid portion 72. A fixed iron core 92 is fitted in the upper opening of the plunger chamber 91. The fixed core 92 separates the plunger chamber 91 from the valve chamber 73. A plunger, which is a cup-shaped movable iron core 93, is accommodated in the plunger chamber 91. The movable core 93 reciprocates in the axial direction of the valve housing 71. A follower spring 94 is located between the movable core 93 and the bottom surface of the plunger chamber 91.

A guide hole 95 is formed in the fixed iron core 92, which functions as a dividing wall, to connect the plunger chamber 91 with the valve chamber 73. A sliding rod 96 is integral with the valve body 74 and is fitted in the guide hole 95. The end of the rod 96 that is closer to the movable core 93 is pressed against the movable core 93 by the force of the spring 76 and the follower spring 94. Therefore, the movable core 93 and the valve body 74 are operably coupled to each other by the rod 96.

A communication groove 81 is formed in the side of the fixed core 92. A communication hole 82 is formed in the valve housing 71. A small chamber 83 is defined between the control valve 49 and an inner wall of the rear housing 13. The plunger chamber 91 is connected to the port 90 through the groove 81, the hole 82 and the chamber 83. That is, the pressure in the plunger chamber 91 is the crank chamber pressure, which is the same as the pressure in the port 90.

A cylindrical coil 97 is located radially outward of both the fixed core 92 and the movable core 93. The coil 97 is connected to a drive circuit 61. The drive circuit 61 supplies current to the coil 97 in accordance with command signals from the computer 57.

As shown in an enlarged oblong window A in FIG. 1A, the part of the rod 89 that faces the inner surface 88*a* of the guide hole 88 includes a cylindrical seal surface 89*a* and a tapered surface 89*b*. The tapered surface 89*b* is adjacent to the seal surface 89*a* and is closer to the port 90 (to the valve body). The diameter of the tapered surface 89*b* decreases toward the port 90. Therefore, the space between the tapered surface 89*b* of the rod 89 and the inner surface 88*a* of the guide hole 88 is greater in the vicinity of the port 90 than in the vicinity of the pressure sensing chamber 84 (drive member).

As shown in an enlarged oblong window B, part of the rod 96 that faces the inner surface 95*a* of the guide hole 95 includes a cylindrical seal surface 96*a* and a tapered surface 96*b*. The tapered surface 96*b* is adjacent to the seal surface 96*a* and is closer to the valve chamber 73. The diameter of the tapered surface 96*b* decreases toward the valve chamber 73. Therefore, the space between the tapered surface 96*b* of the rod 96 and the inner surface 95*a* of the guide hole 95 is greater in the vicinity of the valve chamber 73 than in the vicinity of the plunger chamber 91 (drive member).

The tapered surfaces 89*b*, 96*b* of the rods 89, 96 are machined such that parts adjacent to the port 90 and the valve chamber 73 have smaller diameters even if there are machining errors. That is, this embodiment is characterized in that the outer surfaces of the rods 89,96 are machined such that the spaces between the surfaces of the rods 89, 96 and the inner surfaces 88*a*, 95*a* of the guide holes 88, 95 increase toward the high pressure locations. In the oblong windows A, B, the tapered surfaces 89*b*, 96*b* are exaggerated for purposes of illustration. Actually, the diameter difference between each large diameter portion and the corresponding small diameter portion is between a few micro meters to a few tens of micro meters.

The operation of the displacement control valve 49 will now be described.

When the air conditioner switch 60 is on, the computer 57 commands the solenoid portion 72 to be excited if the temperature detected by the compartment temperature sensor 59 exceeds the target temperature set by the temperature adjuster 58. Accordingly, a current is supplied to the coil 97 through the drive circuit 61, which generates an attraction force between the cores 92, 93. The attraction force is transmitted to the valve body 74 against the force of the spring 76 and moves the valve body 74 in the direction reducing the opening size of the valve hole 75.

When the solenoid portion 72 is excited, the bellows 87 is deformed in accordance with variation of the suction pressure, which is applied to the pressure sensing chamber 84 from the suction passage 32 through the pressure introduction passage 50. The deformation of the bellows 87 is transmitted to the valve body 74 by the rod 89. The opening size of the valve hole 75 is therefore determined by the equilibrium of the force of the solenoid portion 72, the force of the bellows 87 and the force of the spring 76.

When the temperature detected by the sensor 59 is far higher than the temperature set by the adjuster 58, the cooling load is great. The computer 57 controls the current value to change the target suction pressure based on the detected temperature and the target temperature. Particularly, the computer 57 commands the drive circuit 61 to increase the magnitude of the current as the detected temperature increases. A higher current magnitude increases the attractive force between the fixed core 92 and the movable core 93 thereby increasing the force that causes the valve body 74 to close the valve hole 75. Accordingly, the valve body 74 opens and closes the valve hole 75 at a lower suction pressure. Therefore, a greater current magnitude causes the control valve 49 to maintain a lower suction pressure.

A smaller opening size of the valve hole 75 represents less refrigerant gas supplied to the crank chamber 15 from the discharge chamber 39 through the control passage 48. On the other hand, refrigerant gas in the crank chamber 15 flows to the suction chamber 38 through the passage 46, the pressure release hole 47, the accommodation chamber 27 and a communication hole 45, which lowers the pressure in the crank chamber 15. Further, when the cooling load is great, the pressure in the suction chamber 38 is high and the difference between the pressure in the crank chamber 15 and the pressure in the cylinder bores 12*a* is small. Accordingly, the inclination of the swash plate 23 is increased.

When the cross-sectional area of the control passage 48 is zero, or when the end surface 74*a* of the valve body 74 contacts the inner wall of the valve chamber 73 to completely close the valve hole 75, highly pressurized refrigerant gas is not supplied from the discharge chamber 39 to the crank chamber 15. The pressure in the crank chamber 15 is thus substantially equalized with the pressure in the suction chamber 38, which maximizes the inclination of the swash plate 23. The compressor displacement is thus maximized.

When the temperature detected by the sensor 59 is close to the temperature set by the adjuster 58, the cooling load is small. The computer 57 commands the drive circuit 61 to decrease the magnitude of the current as the detected temperature decreases. A lower current magnitude decreases the attractive force between the fixed core 92 and the movable core 93 thereby decreasing the force that causes the valve body 74 to close the valve hole 75. Accordingly, the valve body 74 opens and closes the valve hole 75 at a higher suction pressure. Therefore, a smaller current magnitude causes the control valve 49 to maintain a higher suction pressure.

A greater opening size of the valve hole 75 increases the amount of refrigerant gas from the discharge chamber 39 to the crank chamber 15, which raises the pressure in the crank chamber 15. When the cooling load is small, the pressure in the suction chamber 38 is small and the difference between the pressure in the crank chamber 15 and the pressure in the cylinder bores 12*a* is great. Accordingly, the inclination of the swash plate 23 is decreased.

As the cooling load approaches zero, the temperature of the evaporator 55 drops to a frost forming temperature. When the sensor 56 detects a temperature that is lower than or equal to a predetermined temperature, the computer 57 commands the drive circuit 61 to de-excite the solenoid portion 72. The predetermined temperature is a temperature at which frost is likely to form in the evaporator 55. Accordingly, current to the coil 97 is stopped and the solenoid portion 72 is de-excited, which eliminates the attraction force between the fixed core 92 and the movable core 93.

The valve body 74 is then moved downward by the force of the spring 76 against the force of the follower spring 94, which acts on the valve body 74 through the movable core 93. Eventually, the valve body 74 fully opens the valve hole 75. Therefore, a great amount of highly pressurized refrigerant gas is supplied to the crank chamber 15 from the discharge chamber 39 through the control passage 48 and the pressure in the crank chamber 15 is raised. The raised pressure in the crank chamber 15 minimizes the inclination of the swash plate 23 as shown in FIG. 3.

When the switch 60 is turned off, the computer 57 commands the solenoid portion 72 to be de-excited. This also minimizes the inclination of the swash plate 23.

As described above, the valve 49 is controlled in accordance with the magnitude of the current supplied to the coil 97 of the solenoid portion 72. When the magnitude of the current is increased, the valve 49 regulates the control passage 48 at a lower suction pressure. When the magnitude of the current is decreased, on the other hand, the valve 49 regulates the control passage 48 at a higher suction pressure. The inclination of the swash plate 23 is changed to maintain the target suction pressure. Accordingly, the displacement of the compressor is varied.

That is, the control valve 49 changes the target value of the suction pressure in accordance with the value of the current supplied thereto. Also, the valve 49 can cause the compressor to operate at the minimum displacement for any given suction pressure. A compressor equipped with the control valve 49 varies the cooling ability of the refrigerant circuit.

When the inclination of the swash plate 23 is minimum, the shutting surface 34 of the shutter 28 abuts against the positioning surface 33, which closes the suction passage 32. In this state, the cross-sectional area of the suction passage 32 is zero, and refrigerant gas cannot flow from the external refrigerant circuit 52 to the suction chamber 38. When the shutter 28 is at a closed position, at which the shutter 28 disconnects the accommodation chamber 27 from the suction passage 32, the inclination of the swash plate 23 is minimized. The minimum inclination of the swash plate 23 is slightly more than zero degrees. The shutter 28 is moved between the positions for closing and opening the suction passage 32 in accordance with the inclination of the swash plate 23.

Since the minimum inclination angle is not zero degrees, the discharge of the refrigerant gas in the cylinder bores 12*a* to the discharge chamber 39 is maintained. The refrigerant gas sent to the discharge chamber 39 flows in the control passage 48 and then enters the crank chamber 15. The gas in the crank chamber 15 flows to the suction chamber 38 through the passage 46, the interior of the shutter, the pressure release hole 47, the accommodation chamber 27 and the communication hole 45. The gas in the suction chamber 38 is introduced in the cylinder bores 12*a* and is returned to the discharge chamber 39.

That is, when the inclination of the swash plate 23 is minimum, a circulation passage is formed in the compressor. The circulation passage includes the discharge chamber 39, which is discharge pressure zone, the control passage 48, the crank chamber 15, the passage 46, the interior of the shutter 28, the pressure release hole 47, the accommodation chamber 27, the hole 45, the suction chamber 38, which is suction pressure zone, and the cylinder bores 12*a*. Since the pressures in the discharge chamber 39, the crank chamber 15 and the suction chamber 38 are different, refrigerant gas circulates within the circulation passage. The circulation of refrigerant gas causes lubricant oil contained in the gas to lubricate the moving parts of the compressor.

The above embodiment has the following advantages.

(1) The space between the outer surface (89*a*, 89*b*) of the rod 89 and the inner surface 88*a* of the guide hole 88 is greater in the vicinity of the port 90, which is a high pressure location, than in the vicinity of the pressure sensing chamber 84, which is a low pressure location. Therefore, fluid fixation between the rod 89 and the guide hole 88 is prevented. Further, the hysteresis of the control valve 49 is reduced, which prevents the displacement control performance of the control valve 49 from deteriorating. As a result, the size of the solenoid portion 72 is reduced, which reduces the size of the compressor.

Figure 4:
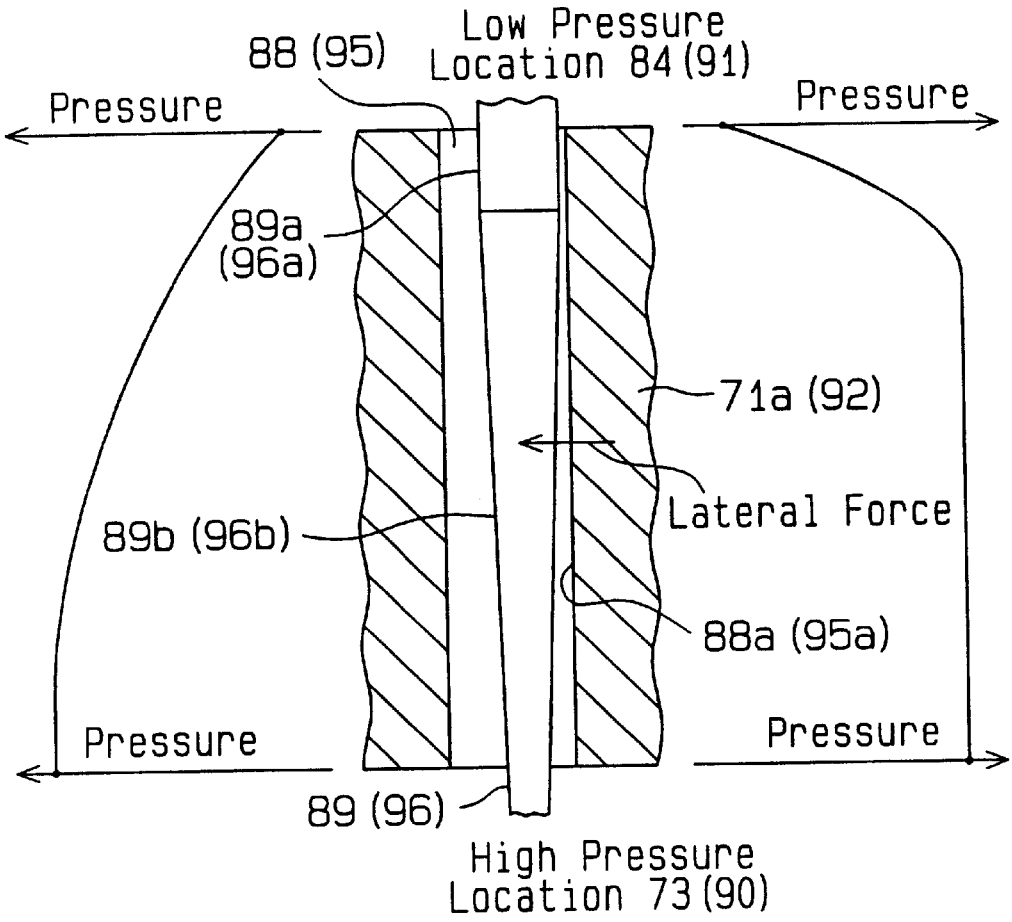
FIG. 4 is a diagram showing operation.

That is, if the axis of the rod 89 is displaced from the axis of the guide hole 88 as shown in FIG. 4 for some reason, the space between the outer surface (89*a*, 89*b*) of the rod 89 and the inner surface 88*a* of the guide hole 88 is narrower on the right side as viewed in FIG. 4. The pressure distribution on the right side of the rod 89 suddenly drops from the tapered surface 89*b* toward the seal surface 89*a*. On the other hand, the space between the outer surface (89*a*, 89*b*) of the rod 89 and the inner surface 88*a* of the guide hole 88 is wider on the left side of the rod 89 as viewed in FIG. 4. The pressure distribution on the left side of the rod 89 gradually decreases from the tapered surface 89*b* toward the seal surface 89*a*. Accordingly, a lateral force, the direction of which is opposite to the direction of the displacement, acts on the rod 89. Therefore, the displacement of the axis of the rod 89 from the axis of the guide hole 88 is automatically corrected.

(2) In the solenoid portion 72, the space between the outer surface (96*a*, 96*b*) of the rod 96 and the inner surface 95*a* of the guide hole 95 is greater in the vicinity of the valve chamber 73, which is a high pressure location, than in the vicinity of the plunger chamber 91, which is a low pressure location. The solenoid portion 72 therefore has the advantage (1).

(3) The compressor of this embodiment varies the displacement by adjusting the amount of refrigerant gas flowing into the crank chamber 15. The valve chamber 73 of the control valve 49 receives highly pressurized discharge refrigerant gas. Therefore, fluid fixation between the rod 96 and the guide hole 95 causes the rod 96 to be pressed against the guide hole 95 by a greater force compared to a control valve that adjusts the amount of refrigerant gas discharged from the crank chamber 15 to control the compressor displacement. The compressor of this embodiment has a particular advantage since the control valve 49 has the means for preventing fluid fixation.

Figure 1B:
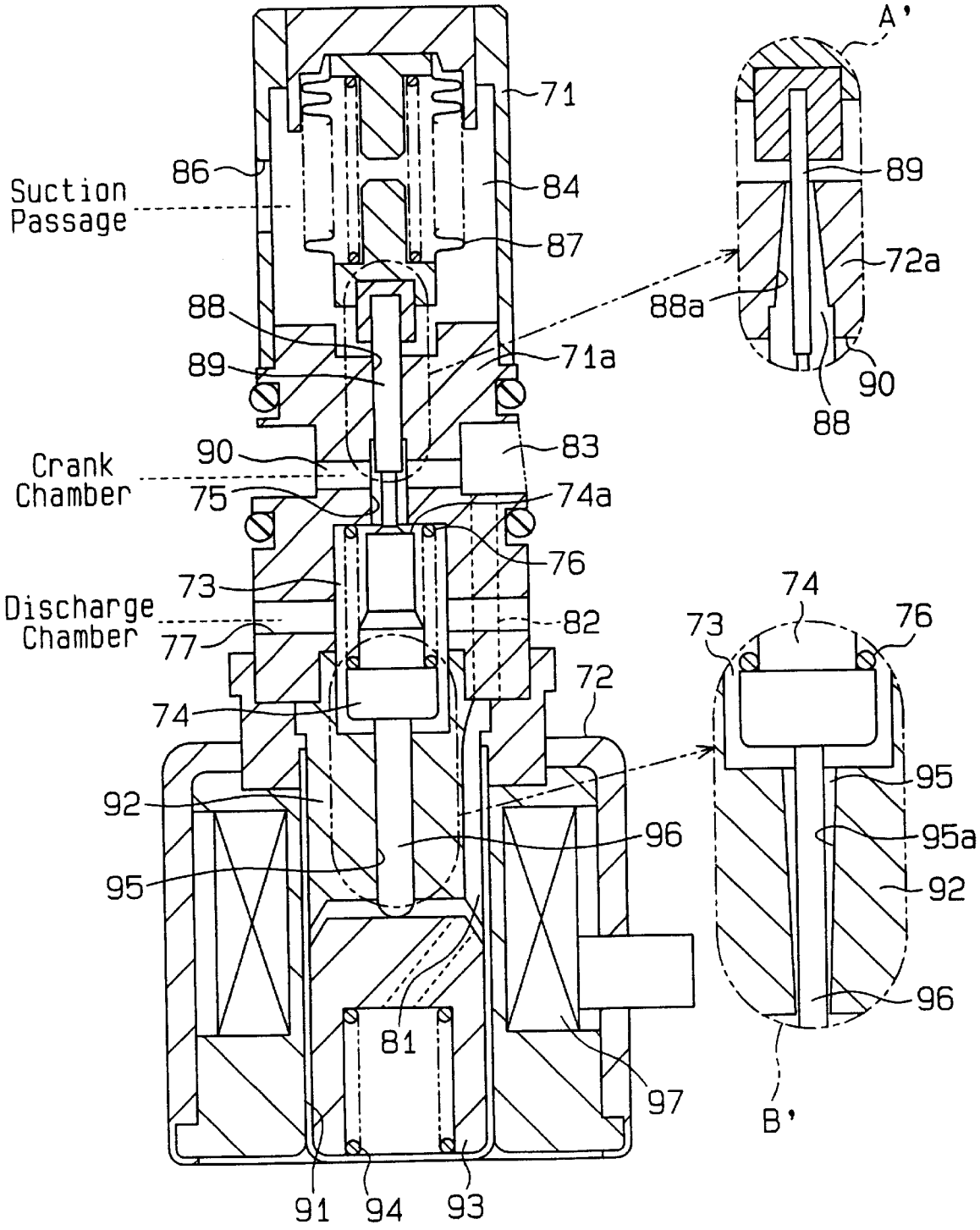
FIG. 1B is a cross-sectional view of a control valve according to the first embodiment, in which the inner surface of the guide hole is tapered.

In the first embodiment, the tapered surfaces are formed on the rods 89, 96. However, as shown in enlarged oblong windows A' and B' of FIG. 1B, tapered surfaces may be formed in the guide holes 88, 95. According to this structure, the spaces between the outer surface of the rods 89, 96 and the inner surfaces of the guide holes 88, 95 are wider in the vicinity of the high pressure locations compared to the vicinity of the low pressure locations. In this case, the diameter of the tapered surfaces increase toward the high pressure locations.

Figure 1C:
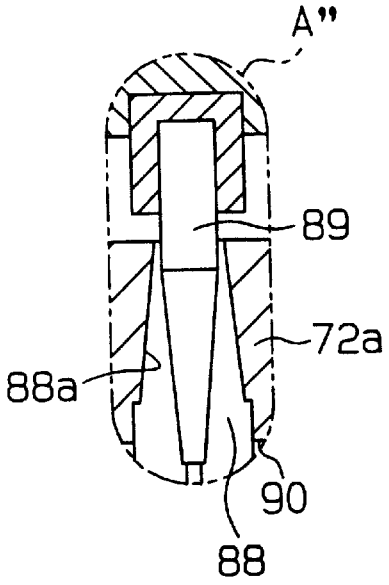
FIGS. 1C and 1D are enlarged partial cross-sectional views of the control valve according to the first embodiment, in which the outer surface of the rod and the inner surface of the guide hole are both tapered.
Figure 1D:
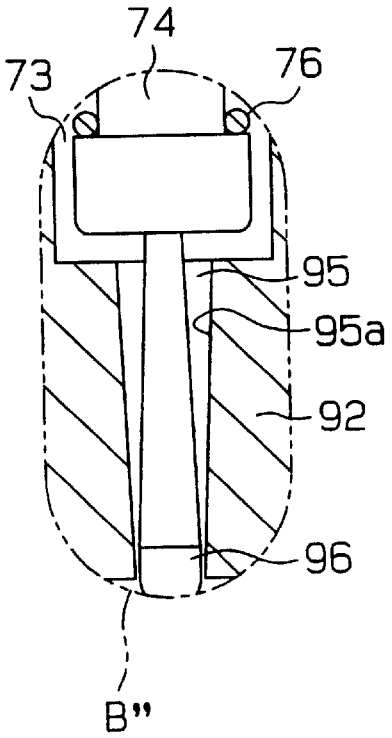

Further, as shown in enlarged oblong windows A" and B" of FIGS. 1C and 1D, tapered surfaces may be formed both on rods 89, 96 and the guide holes 88, 95. According to these structures, the spaces between the outer surfaces of the guide rods 89, 96 and the inner surface of the guide holes 88, 95 are wider in the vicinity of the high pressure locations than in the vicinity of the low pressure locations.

However, it is preferred to form tapered surfaces on the outer surface of the rods 89, 96 as shown in FIG. 1A. This is because forming tapered surface on the guide holes is troublesome. Specifically, the guide holes 88, 95 are formed in the dividing walls 71*a*, 92. Then, a tool must be inserted into the narrow guide holes 88, 95 to taper the inner surfaces.

(Second Embodiment)

Figure 5A:
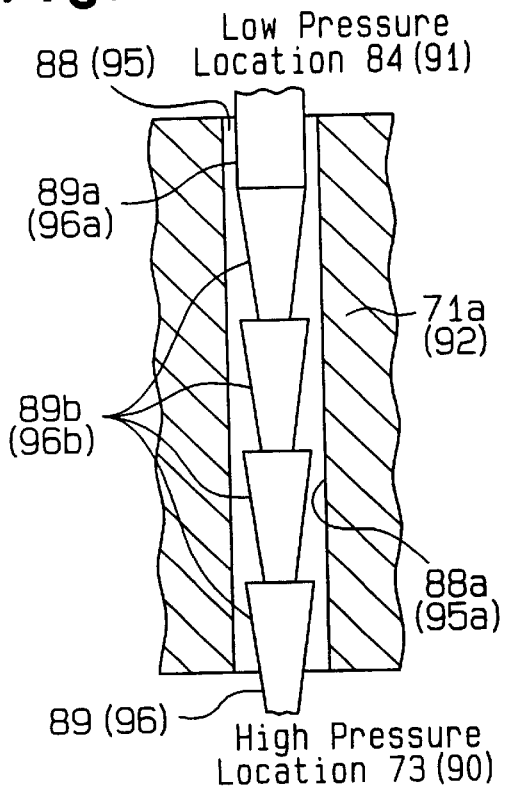
FIG. 5A is an enlarged partial cross-sectional view of a displacement control valve according to a second embodiment, in which a plurality of tapered surfaces are formed on the outer surface of the rod.

FIG. 5A illustrates a second embodiment. In this embodiment, the rods 89, 96 have axially arranged tapered surfaces 89*b*, 96*b*, respectively. Thus, the space between each tapered surface 89*b*, 96*b* and the corresponding inner surface 88*a*, 95*a* increases in size toward the high pressure locations (73, 90) from the low pressure zone (84, 91).

This embodiment has the same advantages as the first embodiment. Further, the cross-sectional areas of the spaces between the tapered surfaces 89*b*, 96*b* of the rods 89, 96 and the inner surfaces 88*a*, 95*a* of the guide holes 88, 95 are complicated in the axial directions. The spaces therefore function as labyrinth seals. The structure thus prevents refrigerant gas leakage between the high pressure location (73, 90) and the low pressure location (84, 91), which improves the displacement control performance of the control valve 49.

Figure 5B:
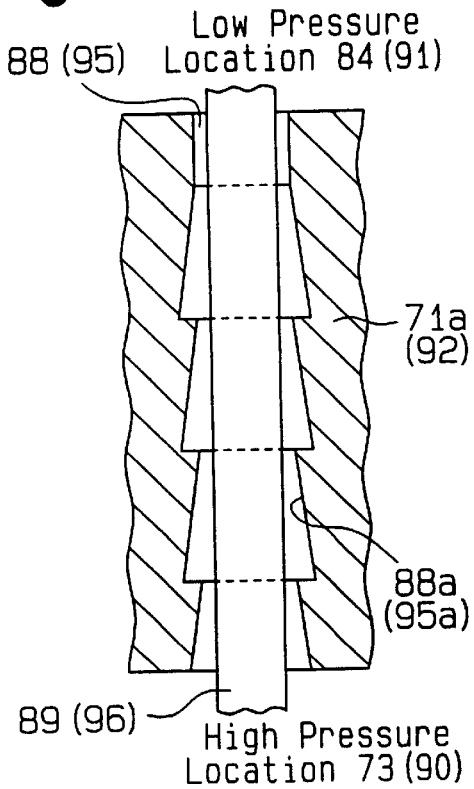
FIG. 5B is an enlarged partial cross-sectional view of a displacement control valve according to the second embodiment, in which a plurality of tapered surfaces are formed on the inner surface of the guide hole.
Figure 5C:
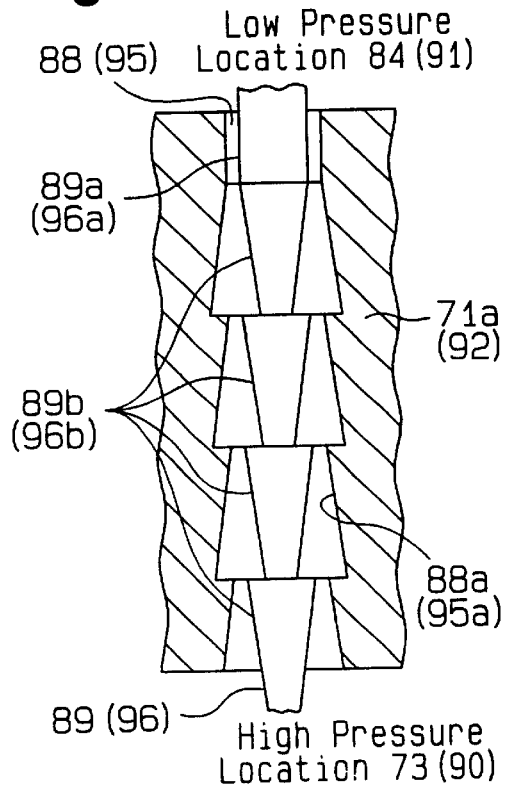
FIG. 5C is an enlarged partial cross-sectional view of a displacement control valve according to the second embodiment, in which a plurality of tapered surfaces are formed on the outer surface of the rod and on the inner surface of the guide hole.

As in the first embodiment, tapered surfaces may be formed on the guide holes 88, 95 as shown in FIG. 5B instead of the tapered surfaces on the rods 89, 96. As shown in FIG. 5C, tapered surfaces may be formed both on the rods 89, 96 and the guide holes 88, 95.

(Third Embodiment)

Figure 6A:
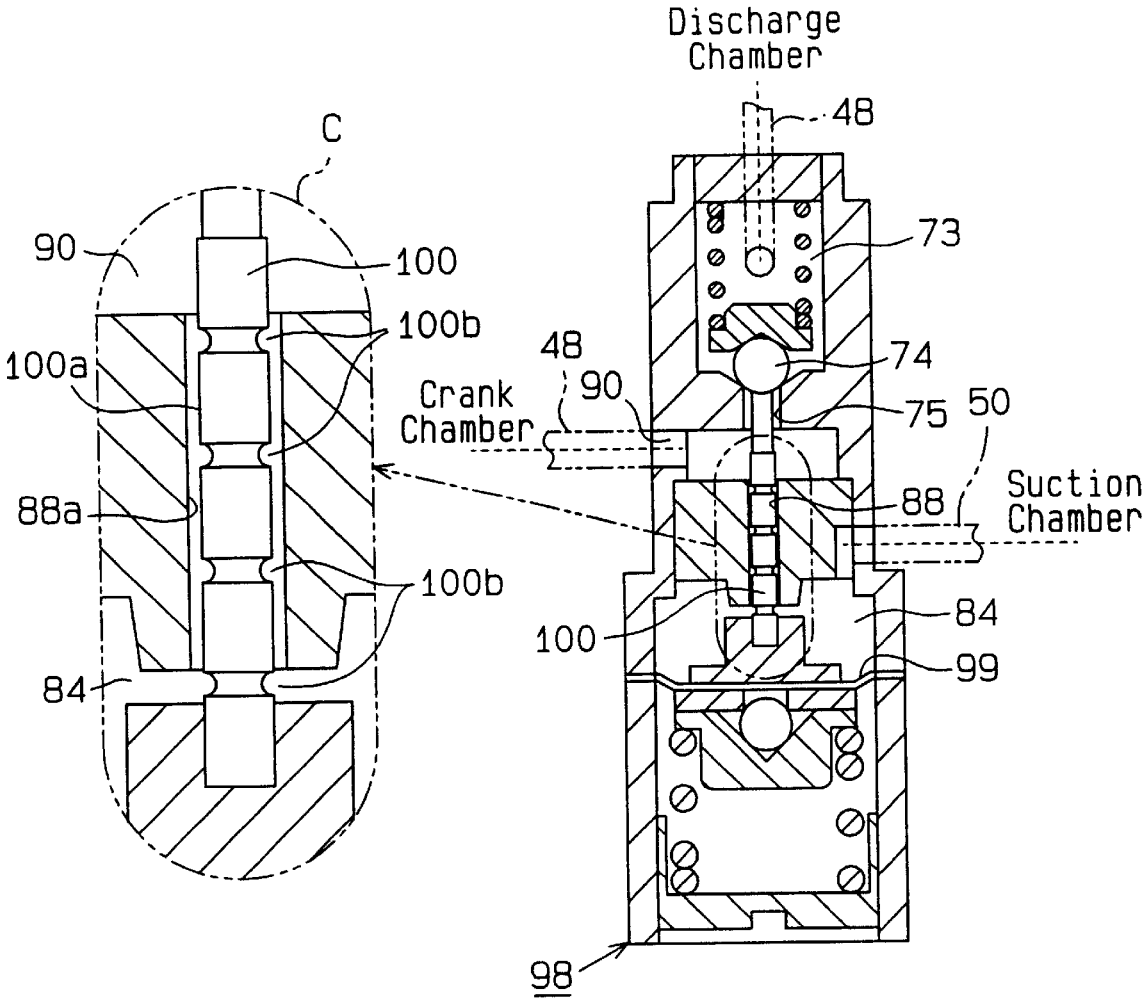
FIG. 6A is a cross sectional view illustrating a displacement control valve according to a third embodiment, in which a plurality of annular grooves are formed on the outer surface of the rod.

FIG. 6A illustrates a third embodiment. A displacement control valve 98 of this embodiment is used for a variable displacement compressor (not shown) that is different from the variable displacement compressor of the first and second embodiments. The control valve 98 only functions as a pressure sensing valve and includes a pressure sensing member, which is a diaphragm 99.

As shown in an enlarged oblong widow C, the valve 98 has a cylindrical rod 100 to operably couple the valve body 74 with the diaphragm 99. Annular grooves 100*b* are formed on the outer surface 100*a* of the rod 100 to face the guide hole 88. The annular grooves 100*b* are axially arranged at equal intervals.

The grooves 100*b* circumferentially equalize the pressure in the space between the outer surface 100*a* of the rod 100 and the inner surface 88*a* of the guide hole 88. As a result, when the axis of the rod 100 is displaced from the axis of the guide hole 88, fluid fixation between the rod 100 and the guide hole 88 is prevented. Thus, the third embodiment has the advantage (1) of the first embodiment.

Figure 6B:
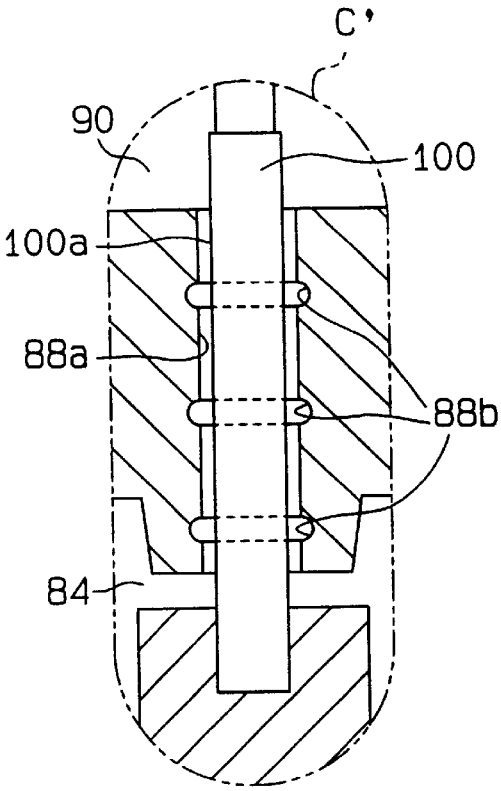
FIG. 6B is a cross sectional view illustrating a displacement control valve according to the third embodiment, in which a plurality of annular grooves are formed on the inner surface of the guide hole.

Instead of forming annular grooves on the outer surface 100*a* of the rod 100, annular grooves 88*b* may be formed on the inner surface 88*a* of the guide hole 88 as shown in an enlarged oblong window C' of FIG. 6B.

Figure 6C:
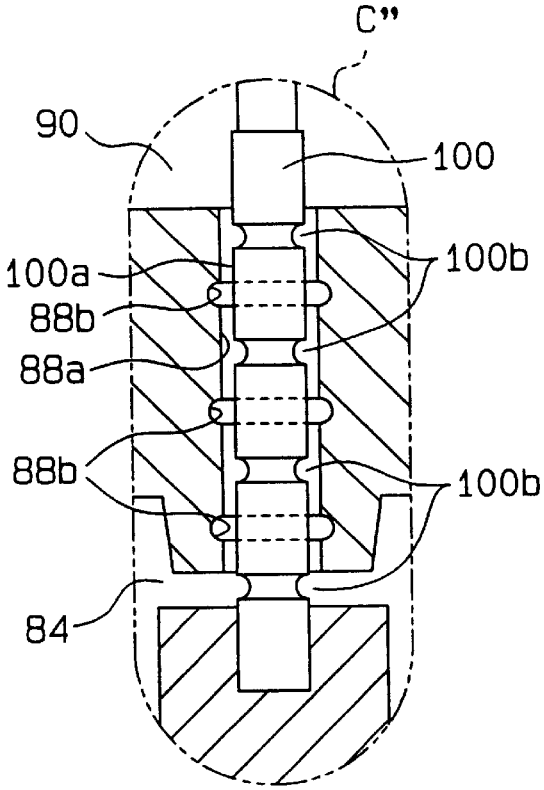
FIG. 6C is a vertical cross sectional view illustrating a displacement control valve according to the third embodiment, in which a plurality of annular grooves are formed both on the outer surface of the rod and on the outer surface of the rod.
Figure 7:
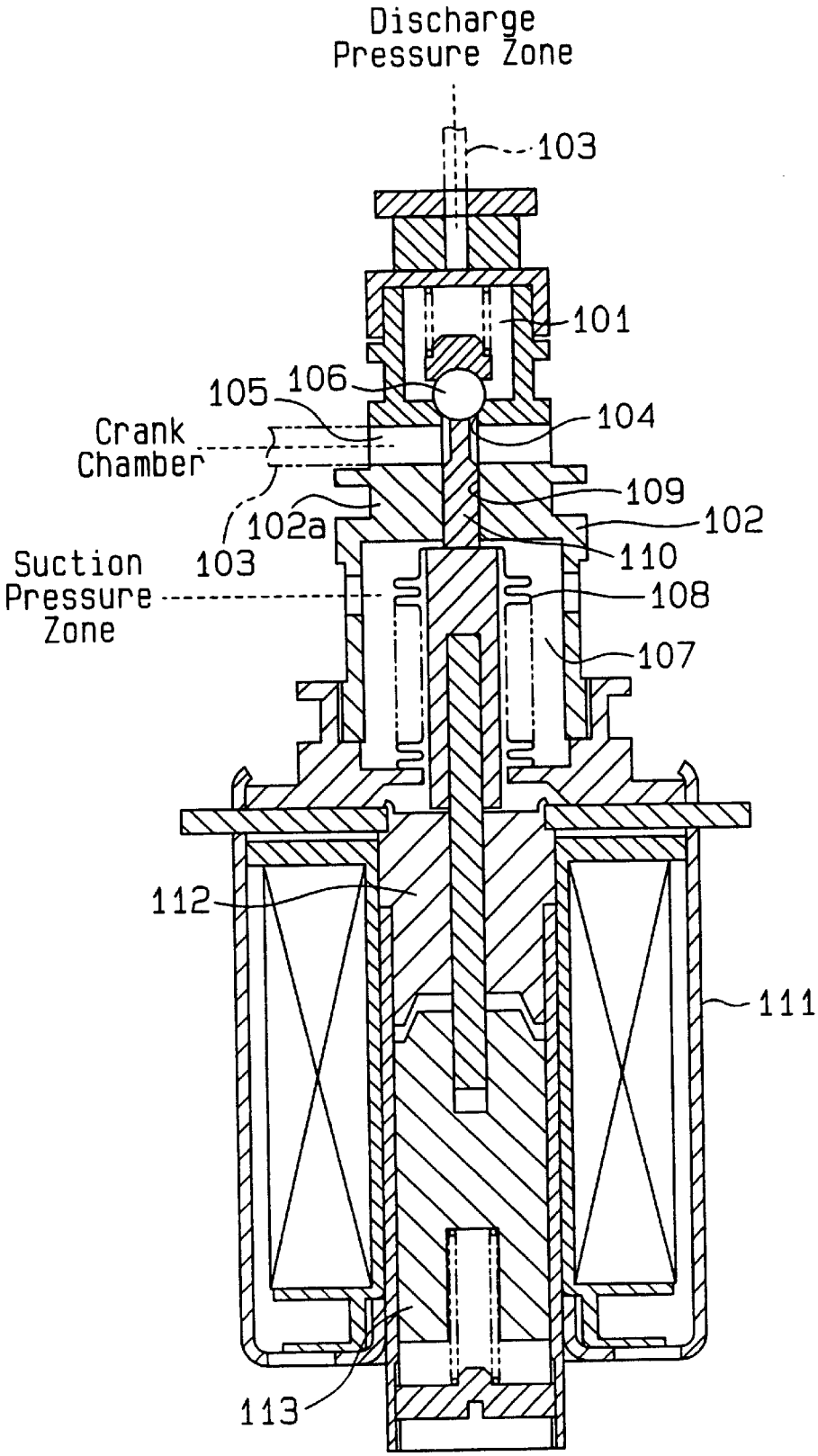
FIG. 7 is a vertical cross-sectional view showing a prior art displacement control valve.

Further, as shown in an enlarged oblong window C" of FIG. 6C, annular grooves may be formed both on the outer surface 100*a* of the rod 100 and on the inner surface 88*a* of the guide hole 88.

However, it is preferred to form the annular grooves on the outer surface 100*a* of the rod 100. This is because forming annular grooves on the inner surface 88*a* of the guide hole 88 is troublesome. Specifically, the guide hole 88 is formed in the dividing walls 71*a*. Then, a tool must be inserted into the narrow guide hole 88 to form annular grooves.

Although several embodiments of the present invention has been described herein, it should be apparent to those skilled in the art that the present invention may be embodied in many other specific forms without departing from the spirit or scope of the invention. For example, the present invention may be embodied in a compressor that only has the electromagnetic valve function 72.

What is claimed is:

1. A control valve for a variable displacement compressor comprising:

a valve chamber;

a valve body located in the valve chamber, wherein the valve body opens and closes a control passage, wherein the control passage connects a control pressure chamber with one of a suction pressure zone and a discharge pressure zone of the compressor, and the valve regulates the size of a portion of the control passage to vary the displacement of the compressor;

an accommodation chamber, wherein the pressure in the accommodation chamber is different from the pressure in the valve chamber;

a driving member located in the accommodation chamber, wherein the driving member applies force to the valve body to drive the valve body;

a rod that moves axially to transmit the force from the driving member to the valve body;

a dividing wall that divides the accommodation chamber from the valve chamber, wherein the dividing wall includes a defining surface that defines a guide hole through which the rod passes, and wherein the rod has an outer surface that faces the defining surface; and means for preventing fluid fixation caused between the outer surface and the defining surface due to the pressure difference between the valve chamber and the accommodation chamber, wherein the fluid fixation preventing means is located on at least one of the outer surface and the defining surface.

2. The control valve according to claim 1, wherein the means includes a tapered surface formed on at least one of the outer surface and the defining surface.

3. The control valve according to claim to claim 2, wherein the tapered surface is one of a plurality of tapered surfaces that compromise the means.

4. The control valve according to claim 2, wherein the rod is tapered such that the diameter of the rod decreases toward the one of the valve chamber and the accommodation chamber that has the highest pressure.

5. The control valve according to claim 1, wherein the means includes an annular groove formed in at least one of the outer surface and the defining surface.

6. The control valve according to claim 5, wherein the annular groove is formed in the rod.

7. The control valve according to claim 1 including a pressure sensing mechanism, wherein the pressure sensing mechanism has a pressure sensing chamber, which serves as the accommodation chamber, and a pressure sensing member, which serves as the driving member, wherein the pressure sensing member drives the valve body through the rod in accordance with the pressure in the pressure sensing chamber.

8. The control valve according to claim 1 including a solenoid, wherein the solenoid moves a plunger, which serves as the driving member, and the rod connects the plunger to the valve body.

9. The control valve according to claim 1, wherein the control passage connects the discharge pressure zone to the control pressure chamber.

10. A control valve for a variable displacement compressor comprising:

a valve chamber;

a valve body located in the valve chamber, wherein the valve body opens and closes a control passage, wherein the control passage connects a control pressure chamber with one of a suction pressure zone and a discharge pressure zone of the compressor, and the valve regulates the size of a portion of the control passage to vary the displacement of the compressor;

an accommodation chamber, wherein the pressure in the accommodation chamber is different from the pressure in the valve chamber;

a driving member located in the accommodation chamber, wherein the driving member applies force to the valve body to drive the valve body;

a rod that moves axially to transmit the force from the driving member to the valve body;

a dividing wall that divides the accommodation chamber from the valve chamber, wherein the dividing wall includes a defining surface that defines a guide hole through which the rod passes, wherein the rod has an outer surface that faces the defining surface, wherein the dimensions of the guide hole and the rod are determined such that a seal is formed between the outer surface and the defining surface; and a space defined by the outer surface and the defining surface for preventing fluid fixation caused between the outer surface and the defining surface due to the pressure difference between the valve chamber and the accommodation chamber, wherein the space permits a gas that flows through an adjacent one of the valve chamber and the accommodation chamber to enter the guide hole and surround the rod to circumferentially equalize the pressure on the rod.

11. The control valve according to claim 10, wherein the space is formed by a tapering of at least one of the outer surface and the defining surface.

12. The control valve according to claim 11, wherein the rod is tapered such that the diameter of the rod decreases toward the one of the valve chamber and the accommodation chamber that has the highest pressure.

13. The control valve according to claim 10, wherein the space is formed by an annular groove formed in at least one of the outer surface and the defining surface.

14. The control valve according to claim 13, wherein the annular groove is formed on the rod.

15. The control valve according to claim 10 including a pressure sensing mechanism, wherein the pressure sensing mechanism has a pressure sensing chamber, which serves as the accommodation chamber, and a pressure sensing member, which serves as the driving member, wherein the pressure sensing member drives the valve body through the rod in accordance with the pressure in the pressure sensing chamber.

16. The control valve according to claim 10 including a solenoid, wherein the solenoid moves a plunger, which serves as the driving member, and the rod connects the plunger to the valve body.

17. The control valve according to claim 10, wherein the control passage connects the discharge pressure zone to the control pressure chamber.

18. A control valve for a variable displacement compressor comprising:

a valve chamber;

a valve body located in the valve chamber, wherein the valve body opens and closes a control passage, wherein the control passage connects a control pressure chamber with one of a suction pressure zone and a discharge pressure zone of the compressor, and the valve regulates the size of a portion of the control passage to vary the displacement of the compressor;

an accommodation chamber, wherein the pressure in the accommodation chamber is different from the pressure in the valve chamber;

a driving member located in the accommodation chamber, wherein the driving member applies force to the valve body to drive the valve body;

a rod that moves axially to transmit the force from the driving member to the valve body; and a dividing wall that divides the accommodation chamber from the valve chamber, wherein the dividing wall includes a defining surface that defines a guide hole through which the rod passes, and wherein the rod has an outer surface that faces the defining surface, wherein a space is formed between the outer surface and the defining surface, and the cross-sectional area of the space increases toward the one of the valve chamber and the accommodation chamber that has the highest pressure.

19. The control valve according to claim 18, wherein the space is formed by a tapering of at least one of the outer surface and the defining surface.

20. The control valve according to claim 19, wherein the rod is tapered such that the diameter of the rod decreases toward the one of the valve chamber and the accommodation chamber that has the highest pressure.

21. The control valve according to claim 19, wherein the guide hole is tapered such that the diameter of the guide hole decreases toward the one of the valve chamber and the accommodation chamber that has the lowest pressure.

22. A control valve for a variable displacement compressor comprising:

a valve chamber;

a valve body located in the valve chamber, wherein the valve body opens and closes a control passage, wherein the control passage connects a control pressure chamber with one of a suction pressure zone and a discharge pressure zone of the compressor, and the valve regulates the size of a portion of the control passage to vary the displacement of the compressor;

an accommodation chamber;

a driving member located in the accommodation chamber, wherein the driving member applies force to the valve body to drive the valve body;

a rod that moves axially to transmit the force from the driving member to the valve body;

a dividing wall that divides the accommodation chamber from the valve chamber, wherein the dividing wall includes a defining surface that defines a guide hole through which the rod passes, and wherein the rod has an outer surface that faces the defining surface; and a plurality of tapered surfaces formed on at least one of the outer surface and the defining surface.

23. A control valve for a variable displacement compressor comprising:

a valve chamber;

a valve body located in the valve chamber, wherein the valve body opens and closes a control passage, wherein the control passage connects a control pressure chamber with one of a suction pressure zone and a discharge pressure zone of the compressor, and the valve regulates the size of a portion of the control passage to vary the displacement of the compressor;

an accommodation chamber;

a driving member located in the accommodation chamber, wherein the driving member applies force to the valve body to drive the valve body;

a rod that moves axially to transmit the force from the driving member to the valve body;

a dividing wall that divides the accommodation chamber from the valve chamber, wherein the dividing wall includes a defining surface that defines a guide hole through which the rod passes, and wherein the rod has an outer surface that faces the defining surface; and an annular groove formed in at least one of the outer surface and the defining surface.

* * * * *

UNITED STATES PATENT AND TRADEMARK OFFICE

CERTIFICATE OF CORRECTION

PATENT NO. : 6,443,707 B1 
DATED : September 3, 2002
INVENTOR(S) : Kimura et al.

It is certified that error appears in the above-identified patent and that said Letters Patent is hereby corrected as shown below:

Title page,
Item [57], ABSTRACT,
Line 8, please delete "space-between" and insert therefore -- space between --;
Line 9, please delete "(89*b* 96*b*)" and insert therefore -- (89*b*, 96*b*) --.

Signed and Sealed this

Eleventh Day of February, 2003

JAMES E. ROGAN
*Director of the United States Patent and Trademark Office*